United States Patent [19]

Zeltzer

[11] 4,187,565

[45] Feb. 12, 1980

[54] WATERBED CONSTRUCTION

[76] Inventor: Lee B. Zeltzer, 3145 Camino Juan Paisano, Tucson, Ariz. 85718

[21] Appl. No.: 857,470

[22] Filed: Dec. 5, 1977

[51] Int. Cl.[2] ..... A47C 27/08

[52] U.S. Cl. ..... 5/451; 5/452

[58] Field of Search ..... 5/368–371

[56] References Cited

U.S. PATENT DOCUMENTS

| | | | |
|---|---|---|---|
| 3,689,949 | 9/1972 | Weinstein et al. | 5/451 |
| 3,840,921 | 10/1974 | LaBianco | 5/452 |
| 3,864,768 | 2/1975 | Fraige et al. | 5/452 |
| 4,015,299 | 4/1977 | Tinnel | 5/451 |
| 4,057,862 | 11/1977 | LaBianco | 5/452 |

*Primary Examiner*—Casmir A. Nunberg
*Attorney, Agent, or Firm*—J. Michael McClanahan

[57] ABSTRACT

Soft-sided waterbed construction including water absorbent mattress foam support frame surrounding a water filled mattress at its perimeter and water retaining mattress liner means juxtaposed the water filled mattress, said water retaining liner encompassing at least two sides of the triangular shaped foam support means, the uncovered surface side of said foam support means juxtaposed said water filled mattress whereby in the event of water filled mattress leak, the water is retained within the liner and the water absorbent foam support.

10 Claims, 4 Drawing Figures

WATERBED CONSTRUCTION

BACKGROUND OF THE INVENTION

Waterbeds, which have been known for many years to hospitals, have been used to care for burn victims and patients who spend considerable lengths of time in bed because of the advantages, inter alia, that a person's weight is spread equally over all points of contact with the mattress which tends to eliminate bed sores and other types of ailments caused by pressure upon parts of the human body resulting from the stoppage of blood flow.

The waterbed construction has evolved from the first beginnings requiring four sided and bottom support to the present soft sides and support only for the bottom.

There has always been a need that the waterbed mattress be fitted with a waterproof liner where in the event the water mattress sprang a leak, the liner would contain the water within the constructed frame and prevent water spillage onto the floor.

Because virtually 100% of all waterbed purchasers tend to overfill the water matress, the problem of eventual spillage of water from an overflowing liner has always been present. This problem has been accentuated with the transition from the original waterbed construction with the liner fitted within the wood or metal sided container housing the waterbed mattress to the present soft-sided waterbed construction. In the soft-sided waterbed construction the liner covers the bottom and sides of the concave shaped cavity adapted to receive the water mattress. Thus as it can be seen, in the present soft-sided waterbed construction the potentiality for water spillage from a mattress leak has been greatly enhanced because the volume available to receive the leakage water has been reduced.

This problem has of late become such a primary concern of the waterbed industry that at the Spring 1977 Convention, the primary topic discussed was the insufficiency of present waterbed liners to adequately confront the leakage problem.

It is the solution of this problem to which the present invention is directed.

SUMMARY OF THE INVENTION

The present invention comprises a soft sided waterbed construction having a perimeter totally surrounded by a triangular shaped water absorbent open cell polyurethane and a bottom lying vinyl liner which passes under the triangular shaped soft side and encompasses the perimeter wall of the soft sides. In this case, should leaks develop, the vinyl liner will hold all the water, the water absorbent open cell polyurethane assisting by also absorbing the leaked water and thus provide the safety margin against any spillage of liquid beyond the confines of the waterbed.

Accordingly, one of the objects of the present invention is to provide a soft sided waterbed with a safety liner which will contain all the water in the waterbed mattress.

Another object of the present invention is to provide water absorbing means as part of the construction of soft sided waterbeds.

Still another object of the present invention is to provide a safety liner with included water absorbent material.

DETAILED DESCRIPTION OF PREFERRED EMBODIMENT

Figure 1:
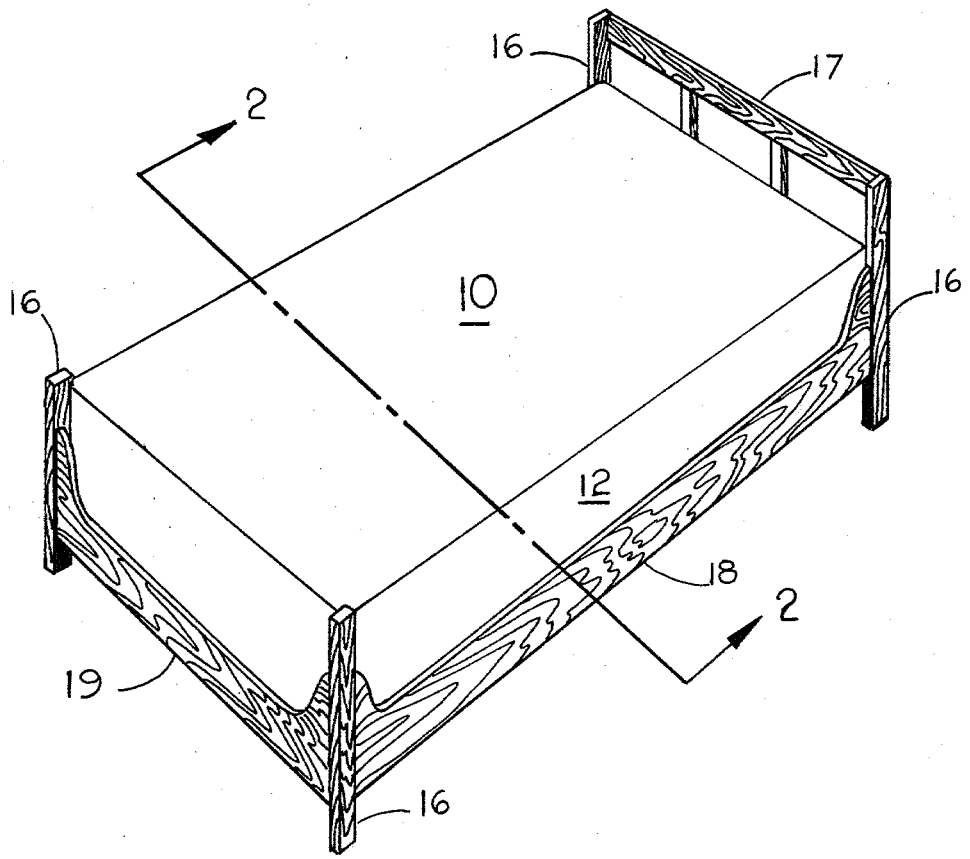
FIG. 1 is a perspective view of the present invention in a standard waterbed frame configuration.

Referring now to FIG. 1, a perspective view of the inventive waterbed construction is shown in a standard bed frame built to support the water mattress. Setting atop the bed frame is mattress 10 which has under and surrounding it on all four sides liner 12. Under liner 12, right angle triangular shaped foam pieces are arranged in a rectangular shape so that the perpendicular side of the right triangle joins the outside edge of the mattress 10 to form a vertical surrounding wall and perimeter of the bed. The remaining structure shown in FIG. 1 are the four corner bed posts 16, head frame 17, horizontal side supports 18, and horizontal end support 19.

Figure 2:
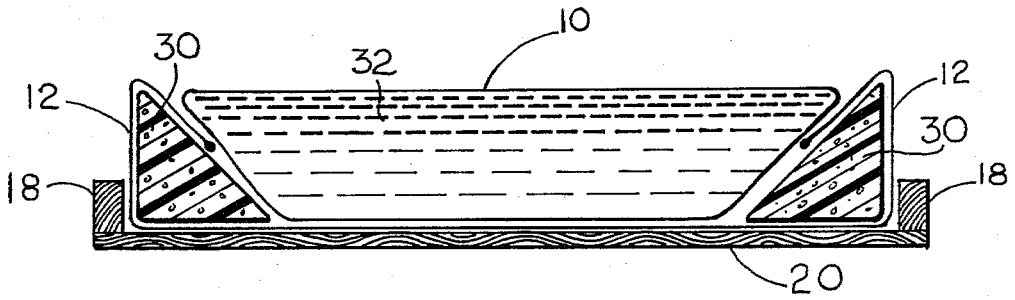
FIG. 2 is a sectional drawing of the inventive waterbed construction taken along section lines 2—2.

FIG. 2 is a cross-sectional view of the inventive waterbed construction taken along sectional line 2—2 of FIG. 1. In FIG. 2, the components are shown not touching for clarity. It should be realized that all components shown do in fact touch along all shown common areas. Beginning at the bottom, bottom support 20, nominally plywood or the presently available particle board, provides support for the mattress and has at either side, horizontal side supports 18 which are attached to bottom support 20 by means of nails, adhesive, wood screws or the like. In fact, horizontal side supports 18 and bottom support 20 may be fitted together in a tongue and groove fashion if desired.

Moving upward, liner 12 is shown in place covering bottom support 20, the outsides of triangular foam members 30, and over the edge of foam members 30 and down into the central cavity a distance sufficient to be held in place by the water filled mattress 10 there above. The foam supports 30 nominally nest next to horizontal side supports 18 although it has been found, due to the construction of the invention, that the horizontal side supports 18 are not necessary to provide side supports to the triangular foam support and may be removed. The weight of the water filled mattress together with the placement of the liner as shown are sufficient to hold the side supports in place and protect against lateral slippage. Lastly, waterbed mattress 10 is shown in place filled in its interior 32 with water or other suitable liquid.

The construction of the invention which provides a soft-sided waterbed with the feature that in the event of a leak in the waterbed mattress, the liner is still capable of holding all the water contained in the waterbed mattress is provided by two co-acting factors, namely, the construction and placement of the liner and the choice of the foam support which is utilized for the soft sides. In the preferred embodiment, an open cell polyurethane has been used with the desired results, providing the necessarily firmness yet capable of absorbing a volume of water equal to about 90% of its own volume. It is suggested that other plastic or rubber type materials with similar characteristics may be used. The liner 12 and the mattress 10 are normally constructed out of 20 mil thick vinyl plastic which provides a relatively thick and waterproof container.

It has been found preferable, in the preferred embodiment, that the side of the right triangle foam support should rise approximately $\frac{1}{4}$ to $\frac{1}{2}$ inch above the touching edge of the water mattress. Thus, with the arrangement shown in FIG. 2, in the event of leak of the water from the waterbed mattress, the water will fill the bottom portion of the liner, soaking into foam support 30 to a level dictated by the total volume of water in the mattress, but never over-flowing the liner 12.

It is noted that while both liner 12 and waterbed mattress 10 are fabricated from the vinyl plastic or other suitable waterproof material, it is recommended that the liner be constructed of pieces of vinyl electronically welded to form an overlapping rolled curl all the way around the perimeter of the liner. However, this invention is not to be limited upon any specific construction of the shape of the liner, as it is apparent that a single sheet of liner on the bottom folded over the entire perimeter of the foam defines the invention, with the extra material at the corners tucked under itself, or eliminated by cutting and welding of the vinyl. The weight of the water mattress keeps the liner in place.

It is realized of course that the cross-sectional view in FIG. 2 additionally represents a cross-sectional view which might be taken along the lengthwise section of the bed with the only change being the horizontal end support 19 being substituted for one of the horizontal side supports 18 and the head frame 17 substituted for the other horizontal side support 18. The invention lies in the improvements of the liner 12, the foam support 30, and the combination of the two.

Figure 3:
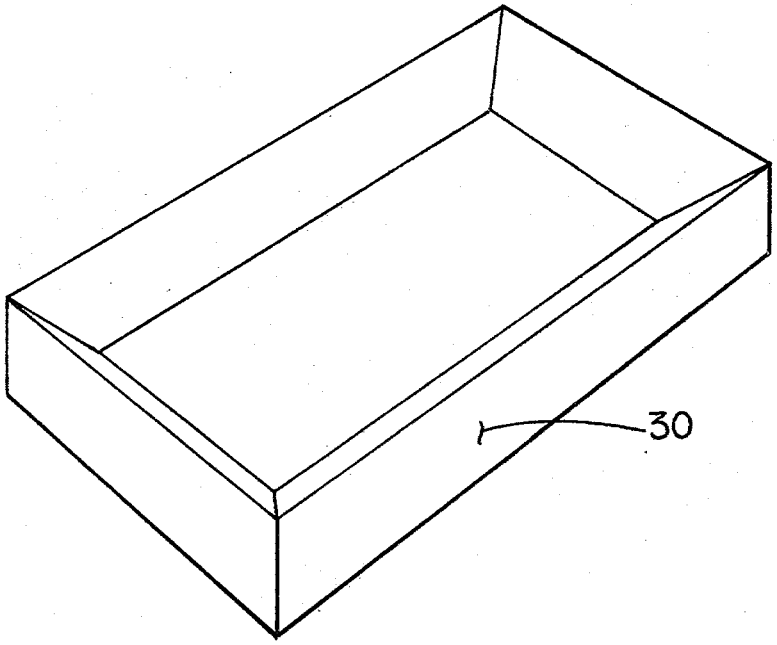
FIG. 3 is a perspective view of the foam support perimeter in which the waterbed mattress is contained.

Referring now to FIG. 3, a perspective view of the right triangular shaped foam support is shown in its entirety, the formed perimeter taking the shape of a rectangle. It is proposed that the rectangular, or other shape as desired to conform to the bed, foam support be one complete piece, which may easily be obtained by merely gluing sections together to form the complete piece. However, it has been determined that the right triangular shaped foam support will retain the shape of the bed when it is held in place by the water mattress and a properly fitted liner. The angle at which the hypotenuse of the right triangle of the triangular shaped foam support 30 makes with the bottom support is not critical; however it has been determined that this angle is dependent upon the deformation resistant quality of the material utilized for the foam support. The more resistant the type of polyurethane utilized, or other open cell porous type material, the smaller the angle may be which the hypotenuse makes with the bottom support.

It is also noted that the stretching tension created within the liner by the filling of the mattress does in fact tend to straigthen the deformation resistance quality of the foam.

As had been noted in FIG. 3, the triangular cross-sectioned foam support 30 conforms generally to the shape of the waterbed and water mattress, and may be molded into a rectangular shaped bed, a square shaped bed, or even a circular bed, or any variation thereof.

It is to be noted that while triangular shaped foam support construction is utilized about the perimeter of the inventive soft-sided waterbed construction, any shape could be used for the foam support construction, including an elongated cylinder or any variations thereof such as an oval or, for that matter a square or rectangle. In either case, it is necessary that the liner covers the outside portion of the water absorbent foam support in up-turning curl fashion in order that the absorbing quality of the foam support may be utilized in the event of mattress leakage.

Figure 4:
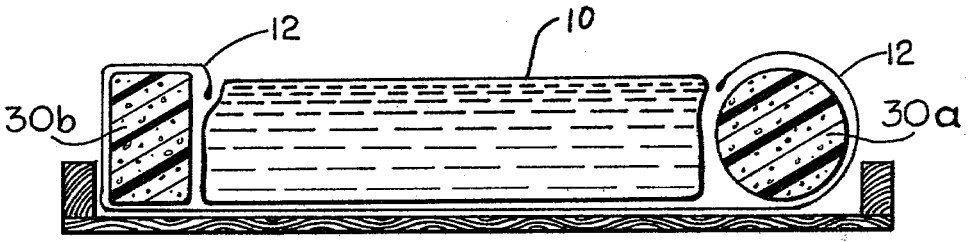
FIG. 4 is a sectional drawing taken along sectional lines 2—2 of FIG. 1 showing two alternate type embodiments of the inventive waterbed construction.

For example, FIG. 4 illustrates a cross-sectional view of an alternate embodiment of the inventive waterbed construction utilizing different construction of foam supports. Cylindrical foam construction 30A has been substituted for triangular shaped foam support 30 still having liner 12 upon the outside and covering a portion of the interior between the waterbed mattress 10 and the foam support 30A.

Similarly, rectangular foam support 30B is shown on the opposite side of liner 12 where the liner traces the path along the outside portion of the foam support 30B to drop interiorly a short distance between the waterbed mattress 10 and the foam support 30B.

Of course, in both examples shown in FIG. 4, the water mattress 10 will lend very little support to holding soft-sides **30*a* and 30*b*** in place, and utilization of side supports attached to the bottom frame support will be necessary.

In both cases, in the event of leakage of the waterbed mattress, subsequent absorption by the water absorbent polyurethane is not inhibited.

While the preferred embodiment has been shown and described, together with two alternate embodiments, it would be understood that there is no intent to limit the invention by such disclosure, but rather it is intended to cover all modifications and alternate constructions falling within the spirit and the scope of the invention as defined in the appended claims.

I claim:

1. Improvements in waterbed construction having lower platform support and water filled mattress thereupon, said improvements comprising side means juxtaposed in touching relationship the outside perimeter of the sides of the water mattress, and waterproof liner means interposed the water mattress and lower platform support, said liner means additionally partially enclosing said side means.

2. The improvements in waterbed construction as defined in claim 1 wherein said side means comprises water absorbent material.

3. The improvements in waterbed construction as defined in claim 2 wherein said liner means partially enclosing said side means passes underneath said side means and curls up to form a substantially vertical wall whereby a container is formed which will contain water which may leak from the associated water mattress.

4. The improvements in waterbed construction as defined in claim 3 wherein said liner means which curls up to form said substantially vertical wall further encircles said side means to join in touching relationship the associated water mattress.

5. The improvements in waterbed construction as defined in claim 4 wherein said side means comprises open cell polyurethane plastic.

6. The improvements in waterbed construction as defined in claim 5 wherein said side means comprises means having a right triangular cross-section.

7. The improvements in waterbed construction as defined in claim 6 wherein said side means comprises means having a circular cross-section.

8. The improvements in waterbed construction as defined in claim 7 wherein said side means comprises means having a rectangular cross-section.

9. The improvements in waterbed construction as defined in claim 3 wherein said liner means which curls up to form said substantially vertical wall continues to encircle said side means less a distance sufficient to permit water to enter the encirclement.

10. Improvements in waterbed construction having lower platform support and water filled mattress resting thereon, said improvements comprising container shaped waterproof liner means and water absorbent materials, said liner means interposed the lower platform support and water mattress, and said water absorbent materials disposed about the perimeter of the water mattress, both said water mattress and the water absorbent materials situated interiorly said container shaped waterproof liner means.

* * * * *